US005117989A

United States Patent [19]

Ross

[11] Patent Number: 5,117,989

[45] Date of Patent: Jun. 2, 1992

[54] SHELF STORAGE FURNITURE APPARATUS

[76] Inventor: Randall S. Ross, 470 Beacon St., Boston, Mass. 02115

[21] Appl. No.: 413,454

[22] Filed: Sep. 27, 1989

[51] Int. Cl.[5] ..... A47F 5/02

[52] U.S. Cl. ..... 211/144; 108/111; 211/186

[58] Field of Search ..... 211/144, 186, 187, 163, 211/189; 108/111, 112; 312/248, 263, 257.1, 140

[56] References Cited

U.S. PATENT DOCUMENTS

| | | | |
|---|---|---|---|
| 455,280 | 6/1891 | Emerson | 211/144 X |
| 2,347,821 | 5/1944 | Goldner | 211/186 X |
| 2,615,771 | 10/1952 | Curtis | 211/189 X |
| 3,069,216 | 12/1962 | Vaeth | 211/186 X |
| 3,433,364 | 3/1969 | Chen | 211/144 X |
| 4,153,311 | 5/1979 | Takahashi | 211/186 X |
| 4,534,473 | 8/1985 | Post | 211/186 X |
| 4,582,002 | 4/1986 | Wright | 211/187 X |
| 4,781,299 | 11/1988 | Oyama | 211/144 |
| 4,799,434 | 1/1989 | Moshofosky | 211/187 X |
| 4,807,539 | 2/1909 | Del Castillo von Haucke | 108/111 |

*Primary Examiner*—David L. Talbott
*Assistant Examiner*—Daniel Hulseberg

[57] ABSTRACT

A bookcase or like storage furniture has at least one shelf element, at least three support post elements, a top cover element, and a bottom base element. The shelf element and the post elements have interfitting mounting slots. The structure facilitates ease of assembly, affords space savings and provides the user with ready access to stored items. A rotary pedestal preferably mounts the bookcase.

6 Claims, 2 Drawing Sheets

SHELF STORAGE FURNITURE APPARATUS

BACKGROUND

This invention relates to bookcases and like shelf storage furniture. Features of the construction which the invention provides are ease in assembly and disassembly, minimal parts, quick access to storage space, and an attractive appearance.

Storage furniture generally, and bookcases specifically, require considerable assembly and, once assembled, take up wall space proportional to the number of books, video cassettes, tape recordings etc. that the storage unit is capable of storing. Those that are configured to conserve wall space do not provide easy access to all stored materials, tend to have many parts, and do not lend themselves readily to assembly and disassembly.

It is an object of this invention to provide a compact, versatile storage system which requires minimal assembly and has few parts. Another object is to provide shelving furniture that provides the user with quick, efficient access to any stored item. A further object is to provide storage furniture that attains the above stated objects and is attractive in appearance.

SUMMARY OF THE INVENTION

A preferred embodiment of the invention is a multisided, contemporary, revolving bookcase or like storage furniture whose unique structure facilitates ease of assembly, affords considerable space savings, and provides the user with quick, efficient access to items stored in the unit.

A bookcase or other article of storage furniture according to the invention includes at least one shelf element, at least three vertical support post elements, a top cover element, and a bottom base element. Each shelf element and the top cover and bottom base elements each typically have identified configurations. A preferred configuration is an (n)-sided polygon, where (n) is an integer of three or more. Spaced about the periphery and extending perpendicular to the storage plane of each shelf element are at least three mounting slots (in a preferred configuration, equal in number to integer (n) sides of shelf, top, and bottom elements).

The number of support posts, in a preferred configuration, is also equal to integer (n) sides of shelf, top, and bottom elements. While the number of mounting slots is always to equal the number of support posts, such number, excepting a preferred configuration as noted, does not necessarily equal integer (n) sides of shelf, top, and bottom elements for every possible configuration. Each support post has a bracket member and optionally, a facing member. The bracket and facing members extend side by side along the axis of the post element. Each bracket member has formed therein slots equal in number to the sum of shelf elements and extending perpendicular to the longitudinal axis and hence parallel to the storage plane(s) of the storage apparatus. Each shelf element is suspended supportively between the vertical support posts by interfitting the slots in the shelf elements with the slots in the bracket members. Shelf elements are free of other connections. The optional facing member abuts the periphery of each shelf element. The shelf element preferably has a peripheral recess that seatingly receives the facing member. In a rectangular embodiment of the invention, the facing elements preferably abut the edges of the shelves at the corners, to close the ends of the shelves.

The post elements, in turn, are in supporting engagement with each shelf element, for providing shelf space on multiple sides about the shelf element periphery.

The storage structure, according to the invention, provides shelf space on multiple sides, and accordingly preferably is mounted on a rotary pedestal. Such mounting provides a rotating lazy-susan type storage cabinet.

BRIEF DESCRIPTION OF THE DRAWINGS

The foregoing and other objects of this invention, the various features thereof, as well as the invention itself, may be more fully understood from the following description, together with the accompanying drawings in which.

DESCRIPTION OF THE ILLUSTRATED EMBODIMENT

Figure 1:
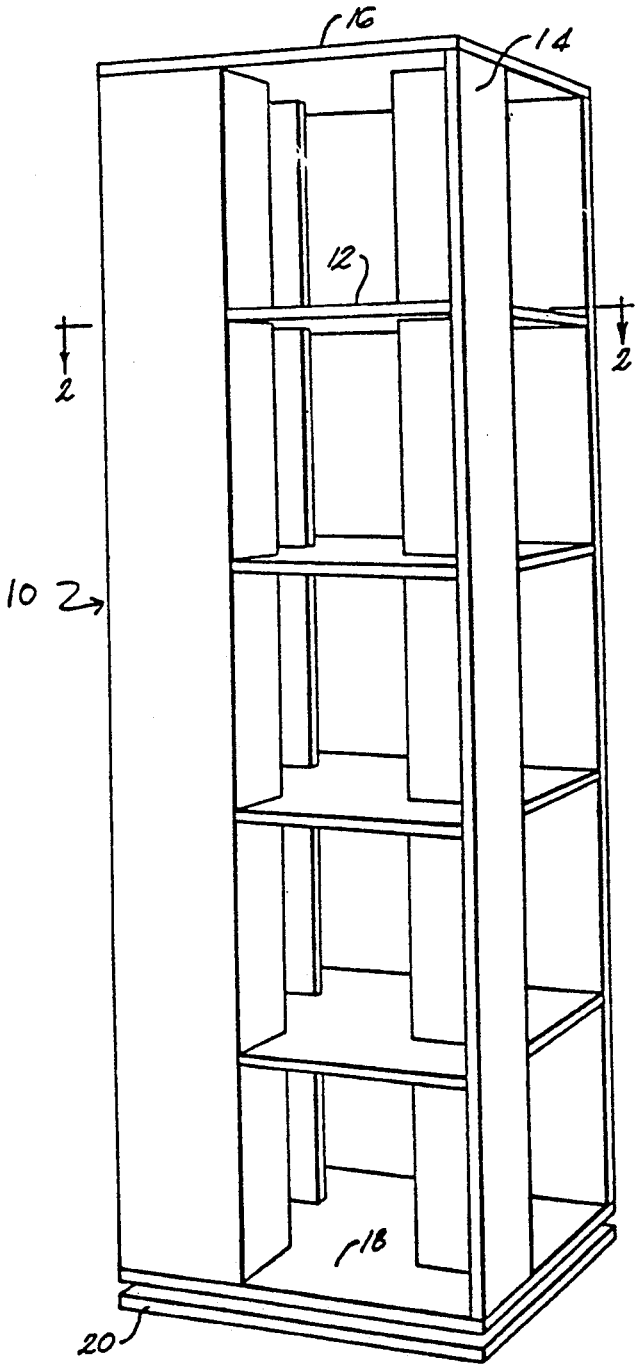
FIG. 1 is a perspective view of a bookcase embodying features of the invention.

FIG. 1 shows that a bookcase 10 in accordance with the invention has four square shelf elements 12 mounted between four vertical support post elements 14. A top cover element 16 and a button base element 18 are fastened to opposed ends of the support post elements 14 to secure them together. An optional rotational pedestal 20 preferably mounts the bookcase.

Figure 2:
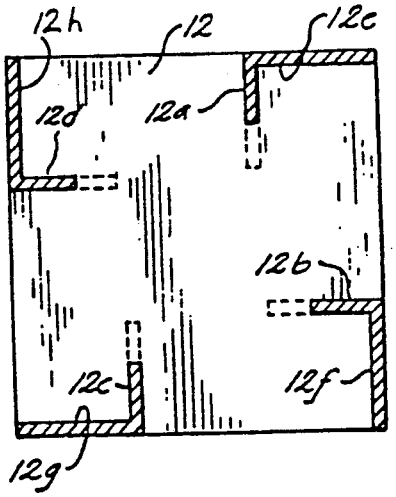
FIG. 2 is a cross sectional view of the bookcase of FIG. 1 taken along line 2—2.

FIG. 2 shows that each shelf element 12 has four mounting slots 12*a–d* spaced about the periphery and extending perpendicular to the storage plane of the shelf. Each shelf element further has four peripheral recesses 12*e–h*, each of which extends along one corner of the shelf element up to one mounting slot, and intersects the mounting slot substantially transversely, e.g. with a right angle. The shelf elements 12 of the bookcase 10, illustrated as square, preferably are identical and are interchangeable.

Figure 3:
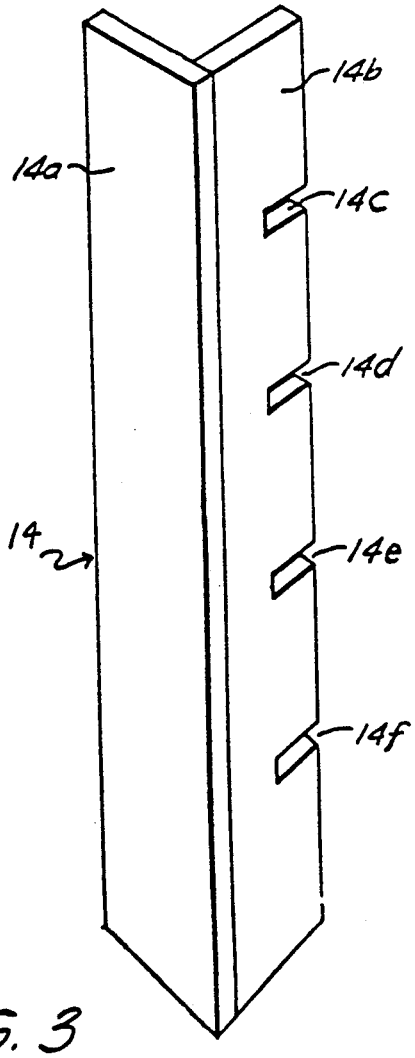
FIG. 3 is a perspective view of a vertical support post element for the bookcase of FIG. 1.

The several vertical support post elements 14 preferably also are identical and interchangeable, with a structure as shown in FIG. 3. The illustrated support post 14 has an optional facing member 14*a* and a bracket member 14*b* that extend side by side along the full length of the post element. The illustrated bracket and facing members of each post element are angled to one another, in an L-configuration. Each bracket member 14*b* has four slots 14*c–f* formed therein and extending perpendicular to the longitudinal post axis. Each of these bracket slots interfits with a shelf slot 12*a–d*, which is corresponding and interchangeable for each shelf.

Figure 4:
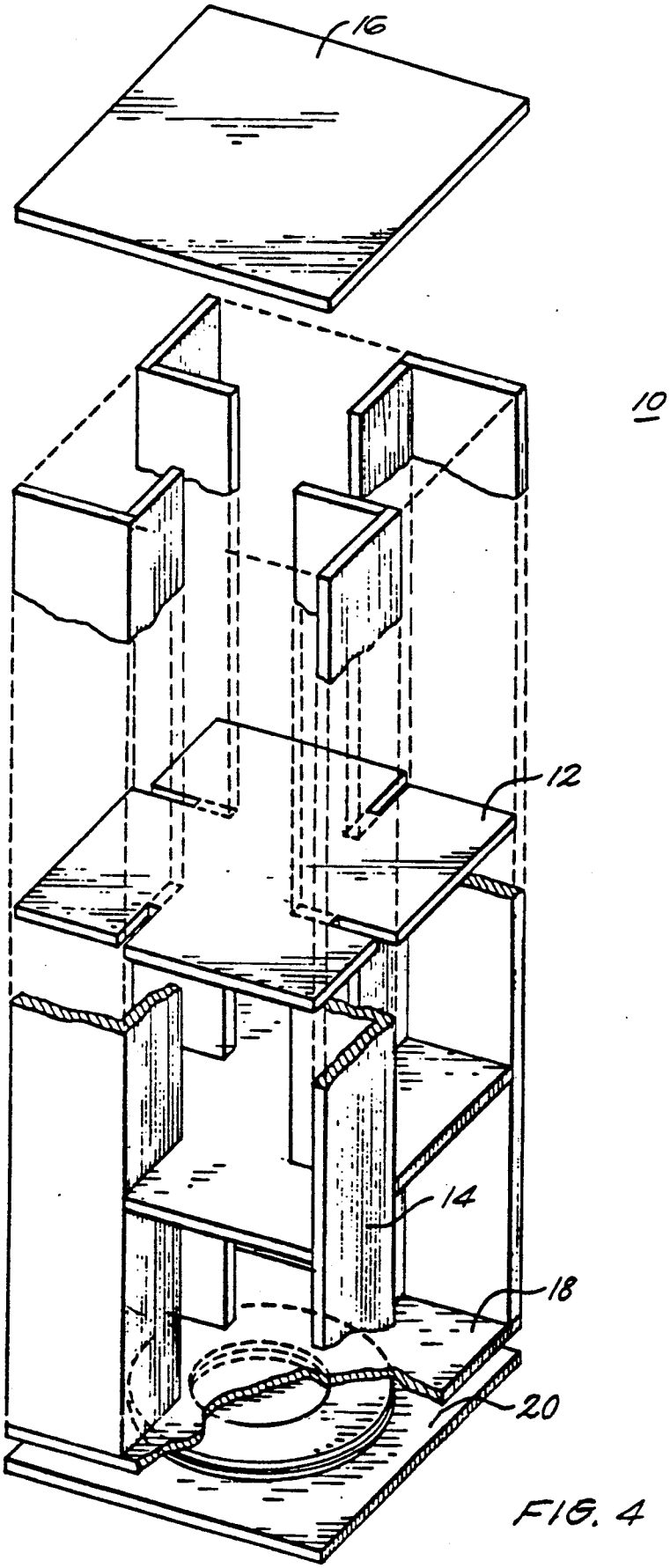
FIG. 4 is a perspective view of the bookcase of FIG. 1, partially exploded and partially broken away.

The partially exploded and partially broken away view of the bookcase 10 in FIG. 4 shows that each shelf element 12 supportingly interfits with the four vertical support post elements 14. The slotted bracket members 14*b* interfit with the slotted shelf elements 12. The facing members 14*a* extend side by side with the bracket members 14*a* and are angled relative to each bracket member in a substantially L-shaped configuration. Each facing member 14*a* abuts the periphery of each of the four shelf elements 12 at one corner, to close the ends of the shelves. Each facing member 14*a* fits flush within one peripheral recess 12*e–h* of the four shelves, to conform with the square periphery of each shelf. The entire bookcase is shown mounted on the optional rotational pedestal 20.

The invention may be embodied in other specific forms without departing from the spirit or essential characteristics thereof. The present embodiment is to be considered as illustrative and not restrictive. The scope of the invention is indicated by the appended claims, rather than by the foregoing description, and all changes which come within the meaning and range of equivalency of the claims are therefore intended to be embraced therein.

What is claimed:

1. A Multi-sided shelf storage apparatus comprising

A. at least one planar shelf element having at least three mounting slots extended perpendicular to the storage plane thereof and spaced about the periphery thereof, B. a top element, C. a bottom element, D. a rotational pedestal means mountingly attached to said bottom element, and E. at least three vertical support post elements, each of which has a longitudinal axis and comprises a post bracket portion and a post facing portion, said post bracket portion and said post facing portion extending side-by-side along said longitudinal axis so as to form a substantially L-shaped configuration, said post bracket portion being formed with a mounting slot therein for each said shelf element, each said post mounting slot being arranged for removably and replacably interfitting with one mounting slot of one said shelf element such that the post bracket portion extends across and perpendicular to the surface of the shelf element, said post facing portion being arranged for abutment with the periphery of a shelf element that is mountingly interfitted with that post element, and each post element further having opposed end sections one of which is arranged for mounting attachment to said top element and the other which is arranged for mounting attachment to said bottom element, F. each said shelf element having the slots thereof mountingly interfitted with the slots of said post elements and being free of further attachment to said post elements, and each of said top and bottom elements being secured to opposed ends of said post elements, for thereby securing said post elements to said top and bottom elements respectively, and in supporting engagement with each said shelf element for providing shelf space on multiple sides about the shelf element periphery.

2. The multi-sided shelf storage apparatus of claim 1 further comprising means forming a peripheral recess in the periphery of each said shelf element contiguously adjacent the slot therein and arranged for seatingly receiving said facing portion of a post element with which that shelf element is mountingly interfitted.

3. The multi-sided shelf storage apparatus of claim 1 wherein said furniture has equilateral shelf elements.

4. The multi-sided shelf storage apparatus of claim 1 in which each said shelf element has a polygonal shape of (n) sides, where (n) is an integer.

5. The multi-sided shelf storage apparatus of claim 4 having (n) of said support post elements where (n) is an integer greater than or equal to integer (n) sides of shelf, top, and bottom elements.

6. The multi-sided shelf storage apparatus of claim 5 where (n) is equal to 4.

* * * * *

UNITED STATES PATENT AND TRADEMARK OFFICE

CERTIFICATE OF CORRECTION

PATENT NO. : 5,117,989

DATED : June 2, 1992

INVENTOR(S) : Randall S. Ross

It is certified that error appears in the above-identified patent and that said Letters Patent is hereby corrected as shown below:

Column 2, line 32: "button" should --bottom--.

Column 2, line 64: "14a" should read --14b--.

Column 3, line 15: "A Multi-sided" should be lower-case: --Multi-sided--.

Signed and Sealed this

Eighteenth Day of August, 1992

*Attest:*

DOUGLAS B. COMER

*Attesting Officer*

*Acting Commissioner of Patents and Trademarks*